US007067794B2

(12) United States Patent
Le Gallo et al.

(10) Patent No.: US 7,067,794 B2
(45) Date of Patent: Jun. 27, 2006

(54) OBSTRUCTION DETECTOR FOR AUTOMOBILE VEHICLE WINDOWS

(75) Inventors: Yann Le Gallo, Orleans (FR); Mickael Lebourgeois, Auvilliers en Gatinais (FR)

(73) Assignee: ArvinMeritor Light Vehicle Systems - France, Sully-sur-Loire (FR)

( * ) Notice: Subject to any disclaimer, the term of this patent is extended or adjusted under 35 U.S.C. 154(b) by 152 days.

(21) Appl. No.: 10/672,083

(22) Filed: Sep. 26, 2003

(65) Prior Publication Data

US 2004/0079867 A1 Apr. 29, 2004

(30) Foreign Application Priority Data

Sep. 26, 2002 (FR) ..... 02 11925

(51) Int. Cl.
*G06M 7/00* (2006.01)
*H01J 40/14* (2006.01)

(52) U.S. Cl. ..... 250/221; 49/25; 340/545.1; 340/555

(58) Field of Classification Search ..... 250/221, 250/222.1, 206, 208; 49/25, 28; 340/555–557, 340/545.1, 545.2, 541; 180/286, 289
See application file for complete search history.

(56) References Cited

U.S. PATENT DOCUMENTS 4,868,871 A * 9/1989 Watson, III ..... 382/103
5,142,152 A * 8/1992 Boiucaner ..... 250/341.7
5,286,967 A 2/1994 Bates
5,410,149 A * 4/1995 Winston et al. ..... 250/221
5,489,891 A * 2/1996 Diong et al. ..... 340/567
5,506,567 A 4/1996 Bichlmaier et al.
5,955,854 A 9/1999 Zhang et al.
6,154,149 A 11/2000 Tyckowski et al.
6,157,024 A * 12/2000 Chapdelaine et al. ..... 250/221
6,271,512 B1 * 8/2001 Lewis ..... 250/221
6,412,813 B1 7/2002 Breed et al.
6,693,273 B1 * 2/2004 O'Connor et al. ..... 250/221
2004/0056199 A1 * 3/2004 O'Connor et al. ..... 250/341.1

FOREIGN PATENT DOCUMENTS

FR 2 675 613 4/1992
WO WO 01/36772 A1 * 5/2001

* cited by examiner

*Primary Examiner*—Stephone B. Allen
*Assistant Examiner*—Suezu Ellis
(74) *Attorney, Agent, or Firm*—Carlson, Gaskey & Olds

(57) ABSTRACT

A vehicle door includes an openable window and a detector with a charge-coupled device sensor. The sensor detects the light distribution proximate to a closing line of the window. If an obstruction is present, the light distribution received by the sensor varies. The light distribution received by sensor is compared with a reference distribution to detect if an obstruction is present. If an obstruction is detected, movement of the window is stopped, allowing any obstruction in the path of the window.

17 Claims, 2 Drawing Sheets

OBSTRUCTION DETECTOR FOR AUTOMOBILE VEHICLE WINDOWS

REFERENCE TO RELATED APPLICATIONS

This patent application claims priority to French Patent Application No. FR 02 11 925 filed on Sep. 26, 2002.

TECHNICAL FIELD

This invention relates generally to an obstruction detector for a vehicle window.

BACKGROUND OF THE INVENTION

Vehicles commonly include electrically powered window winders. If an obstruction is present, the travel of the window must be interrupted. Standard FMVS 118 requires that the maximum pinching force on obstructions of 20 or 65 N/mm is less than 100 N.

French patent FR-B-2 675 613 discloses a mechanical anti-pinch solution. U.S. Pat. No. 5,955,854 discloses an obstruction detection device for a window or another type of power driven openable member. A transmitter/receiver with infrared diodes is located near the front lower corner of the window. When an obstruction is present in the path of the window, the reflected energy increases. The reflected energy can be used to determine if an obstruction is present in the path of the window. When the window is automatically closed, the transmitter transmits a series of 38 kHz pulses (which are frequency modulated over a lower frequency pulse train) with a period P and a 50% duty cycle. The duration of the low frequency pulses is measured at the receiver output. If no obstruction is present, the duration of a pulse at the receiver output is half the period P. If an obstruction is present, the duration of the pulse at the receiver output increases. The obstruction is detected by comparing the duration of a receiver output pulse with a reference duration. The reference duration can be a function of the position of the window, and it may be generated when either the system is connected to the vehicle battery or at the user's command.

Ambient light can affect the detection of the obstruction, and the effects of ambient light can be overcome by detecting the ambient light with another receiver. The detected ambient light is then subtracted from the signal provided by the infrared receiver.

A drawback to this system is that it employs contactless detection, which is not very reliable. U.S. Pat. No. 5,955,854 discloses detecting the characteristics of the window drive motor as a fallback solution, without providing any details.

U.S. Pat. No. 6,154,149 discloses a camera mounted on the exterior rear view mirrors that detects crime, coupled with pattern recognition algorithms. If the field of the camera covers both sides of the plane of the window, the camera can detect any obstructions on both sides of the window and in the path of the window.

U.S. Pat. No. 5,506,567 discloses an infrared alarm for the surveillance of automobile vehicle windows. A transmitter located on the top of the pillar separating the front and rear windows generates modulated infrared beams. The reflected pulse is received by a detector located next to the transmitter. This document is limited to applications such as alarms.

Obstruction detection applies not only to windows, but also to other types of moving openable members, such as for power driven sunroofs.

A simple, reliable and effective obstruction detection system is therefore desired.

SUMMARY OF THE INVENTION

A detector detects the presence of an obstruction in the path of an openable member, such as a window. The detector includes a light sensor and an analysis circuit. The light sensor detects the light distribution along a closing line of the openable member. The analysis circuit then compares the light distribution received by the sensor to a reference distribution. If there is a variation between the comparison, an obstruction is detected.

In one example, the sensor is a charge-coupled device sensor having a plurality of imaging elements. The light distribution can be represented by a histogram of the gray levels of the imaging elements. The detector can also include a lens in the path of the light received by the sensor.

The analysis circuit updates the reference distribution by integration. Integration occurs over time as a function of the ambient brightness detected. The ambient brightness is detected by measuring the light received on the sensor.

The detector can also include a light source that is activated when the light received by the sensor is below a first threshold value. The light source can be deactivated when the light received by the sensor is greater than a second threshold value.

The detector can be employed in an automobile vehicle having a window moveable in an opening to a closing contact line. The sensor detects the area around the closing contact line. In one example, the sensor detects an area extending less than or equal to 3 cm to either side of the closing contact line.

Other characteristics and advantages of the invention are given in the following detailed description of the embodiments of the invention, given by way of example only and in reference to the drawings.

DETAILED DESCRIPTION OF THE PREFERRED EMBODIMENT

Figure 1:
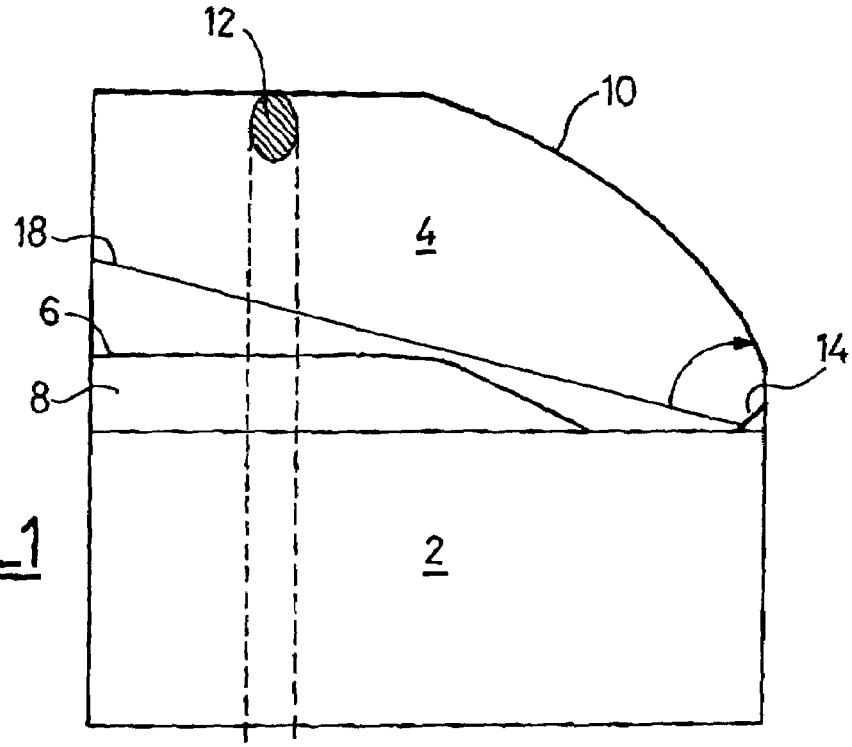
FIG. 1 illustrates a schematic view of a vehicle door employing the detector of the present invention.

FIG. 1 schematically illustrates a vehicle door in which the detector of the present invention may be implemented. The door includes a lower part 2 and a window 8 having an upper edge 6 moveable in an opening 4. The window 8 is shown close to the fully open position. An obstruction 12 is located proximate to an upper edge 10 of the opening 4. The upper edge 10 is formed by a window seal. When the window 8 is closing, the detector 14 detects the presence of an obstruction 12 to prevent the force applied to the obstruction 12 from exceeding the maximum force permitted by the standards. Although the illustrated door is a front door, it is to be understood that the detector 14 can be used in any door. Additionally, it is to be understood that the detector 14 of the present invention can be used with other openable members other than windows.

The optical detector 14 is positioned in the front lower corner of the opening 4. The detector 14 can be located approximately where the rear view mirror is attached to the vehicle. The detector 14 "monitors" an approximately vertical angular area or angular sector to detect the presence of an obstruction 12. The area of the angular sector is defined by the upper edge 10 of the opening 4 and a half line 18 extending from the detector 14. That is, the optical detector 14 covers an area proximate to the upper edge 10 of the opening 4 in the plane of the window 8. The angle of the sector depends on the position of the detector 14. Alternately, the detector 14 covers the entire upper edge 10 of the opening 4. It is not necessary to detect the presence of an obstruction 12 near the lower edge of the opening 4. The detector 14 can detect the upper edge 6 of the window 8 from at least 200 mm away from the upper edge 10 of the opening 4. Additionally, two or more detectors 14 can be used.

Preferably, the detector 14 covers a width approximately equal to the thickness of the window seal, or a width of about 4 to 5 cm. That is, the detector 14 "monitors" only the edge of the window 8 and approximately 3 cm on each side of the window 8. The width is defined as a dimension perpendicular to the plane of the window 8 or the plane of the opening 4. The volume covered by the detector 14 is approximately flat and extends around the window 8.

In one example, the detector 14 is a CCD (charge-coupled device) sensor, as known, and includes a lens for focusing and filtering. The lens is located in the path of the light received by the sensor so that the detector 14 can "watch" or cover the angular sector. The imaging elements or pixels of the sensor each provide information about a part of the upper edge 10 of the opening 4. The position of a pixel represents a position along the upper edge 10. The intensity or brightness for a pixel represents the edge 10 or the presence of an obstruction 12. If an obstruction 12 is present, there is a local variation in the brightness of the corresponding pixel.

Preferably, a CCD sensor is used to detect human obstructions, such as the driver's hand, because they are particularly sensitive to infrared light. When a human obstruction 12 is present, there is a significant increase in the brightness detected by the sensor. However, the presence of any other type of obstruction 12 also causes a variation in the brightness detected. For any other obstruction 12 that absorbs light, the variation of the brightness detected decreases.

In one example, a 128×128 pixel CCD sensor is used. The sensor is positioned vertically. A focusing lens focuses the light received by the sensor so that the sensor can "monitor" the upper edge 10 of the opening 4 and a volume extending 3 cm on either side of the upper edge 10 of the opening 4.

A wider sensor can also be used. In this example, only the pixels of the image that correspond to the upper edge 10 of the opening 4 need to be processed. However, the neighboring pixels can be processed if necessary. This may be implemented either when the sensor is installed or by using a pattern recognition program designed to recognize the upper edge 10 of the window 4. As the pattern recognition program only has to recognize a prior known pattern, the program can be relatively crude. If an upper window seal is utilized, the upper edge 10 is black and forms a stark contrast relative to the surroundings. This type of program allows for adjustment to the mounting constraints and adjustment to the dispersion of the door frame and sensor mounting. Normally, the image of the frame is in a known position A. However, due to the mounting dispersions, the image of the frame may be offset to a position B. Preferably, the system calibrates itself to take correct measurements when the frame moves.

Figure 2:
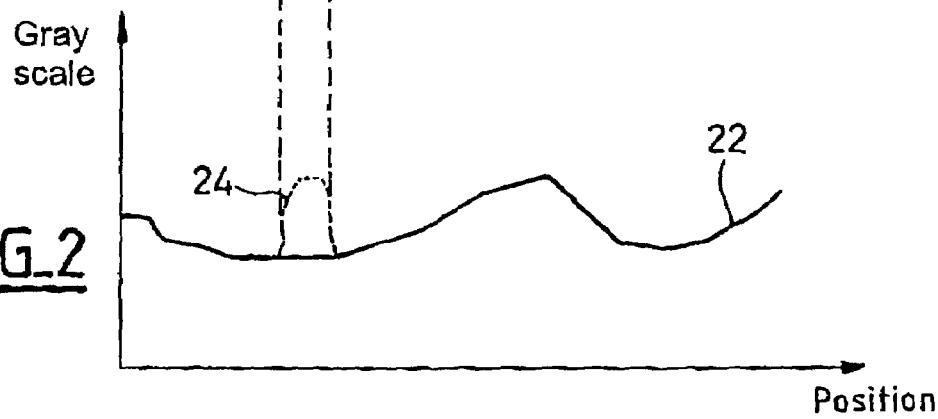
FIG. 2 illustrates a histogram detected by the sensor of the present invention.

FIG. 2 shows a detection histogram 22 detected by the sensor. The x-axis shows the position along the upper edge 10 of the opening 4. Alternatively, the row of pixels can be shown on the x-axis. The two representations are similar and within one transformation if applicable. The transformation accounts for the characteristics of any lens that is coupled to the sensor.

The light intensity received by the sensor is shown on the y-axis. In a 128×128 pixel sensor, the light intensity may simply be the average of the light intensities of the 10 pixels in a given row along the sensor. The light intensity is representative of the light received from a given position along the upper edge 10 of the opening 4, or of the light received from a given direction. If the sensor is monochrome, (which can be sufficient for detection) the brightness can be expressed in the form of gray levels. The light intensity may also be integrated, if applicable, with a variable integration period as explained below.

FIG. 2 shows a reference histogram 22 that is generated when no obstruction 12 is present in the path of the window 8. The brightness is not constant along the upper edge 10. This may be due to the lens, a variable reflection along the upper edge 10 of the opening 4, or simply due to the distance between the sensor and the upper edge 10. The presence of an obstruction 12 in the histogram causes a local variation in the light intensity received by the detector. As shown by the dashed vertical lines between FIGS. 1 and 2, the obstruction 12 generates a local increase 24 in the light intensity received by the detector. FIG. 2 shows an example of an increase in intensity 22 due to a human obstruction 12 and with additional infrared light received by the CCD sensor.

An obstruction 12 can be detected by detecting a variation in local light intensity by the sensor. This variation is detected by comparing the distribution of light with a reference histogram 22. That is, the distribution of the light received by the detector at a given moment is compared with a reference distribution 22. Any variation in the comparison represents the presence of an obstruction 12.

The present invention does not use pattern recognition algorithms as disclosed in U.S. Pat. No. 6,154,149. The present invention is simpler, more reliable, and does not require a prior knowledge of the pattern or the nature of the obstruction 12. Even if a pattern recognition program is used to identify the upper edge 10 of the opening 4, the program can be simple. The present invention is also simpler that the solution disclosed in U.S. Pat. Nos. 5,506,567 or 5,955,854. The entire upper edge 10 of the opening 4 is monitored and not just a portion of the upper edge 10 or in discrete directions.

The reference histogram 22 can be generated at different times. The reference histogram 22 can also be generated in advance by the detector manufacturer. This solution is simple, but may pose a problem if the detector is not assembled accurately. If the detector is offset, at an angle or in translation, the reference histogram 22 is also offset, possibly causing false detection. However, this is not necessarily a problem if spatial recognition of the door frame is used, as explained above.

The reference histogram 22 can also be recorded after the installation of the detector. This allows for the position of the detector on assembly to be taken into account while remaining simple.

The reference histogram 22 can be regularly or automatically updated. Automatic updating may occur whenever the system is started or whenever the window is opened. This takes into account the aging of components, mechanical deformation, dirt, and other parameters that might affect the light detection.

Alternately, the reference histogram 22 can be a histogram that has just been measured, simplifying the detector circuit and avoiding the permanent storage of the histogram.

Figure 3:
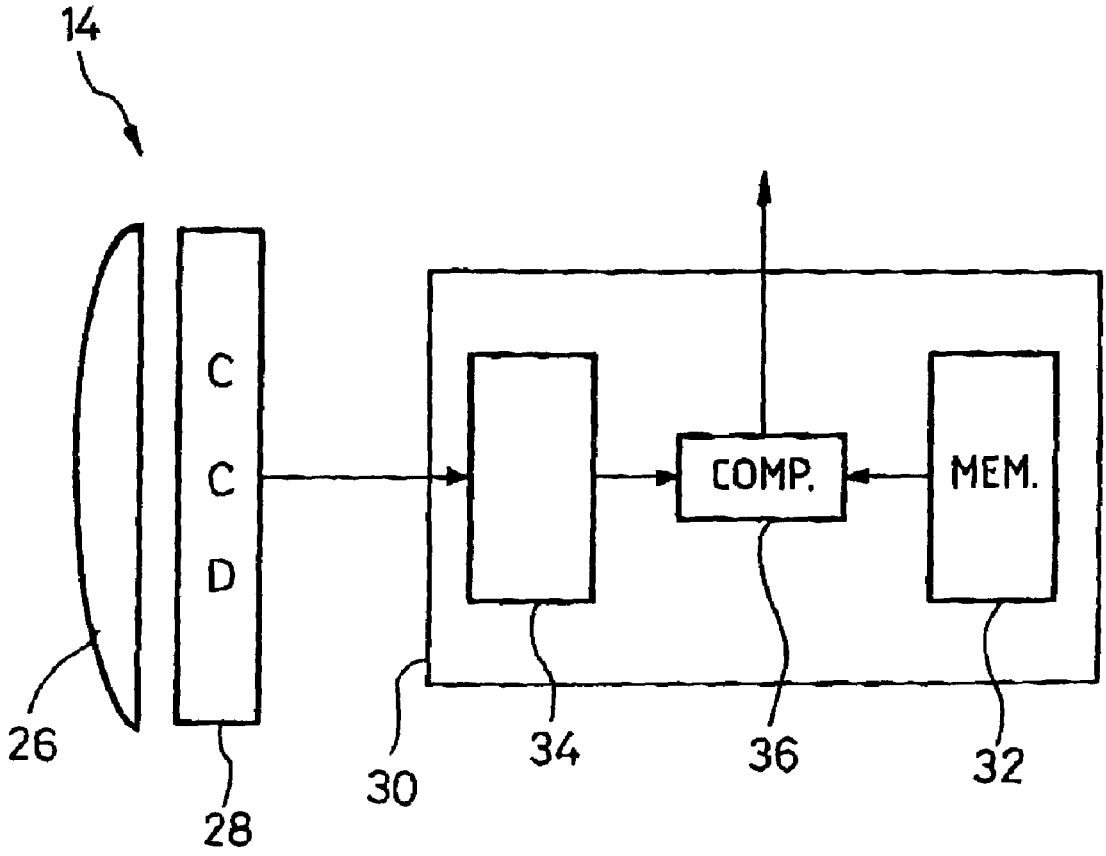
FIG. 3 illustrates the detector of the present invention.

FIG. 3 schematically illustrates one embodiment of the detector 14. The detector 14 includes a lens 26 and a sensor 28. The information detected by the sensor 28 is then provided to a circuit 30. If the sensor 28 is a charge-coupled device sensor, the information is an image. The circuit 30 includes a permanent or non-permanent memory 32 that stores the reference histogram 22, a processing module 34 that generates a histogram from the information provided by the sensor 28, and a comparator 36 that compares the instantaneous histogram and the reference histogram 22. The comparator 36 generates a signal if an obstruction 12 is detected. Although not illustrated, the detector 14 can also include a possible means of updating the reference histogram 22 and a pattern recognition program for calibrating the detector 14.

Figure 4:
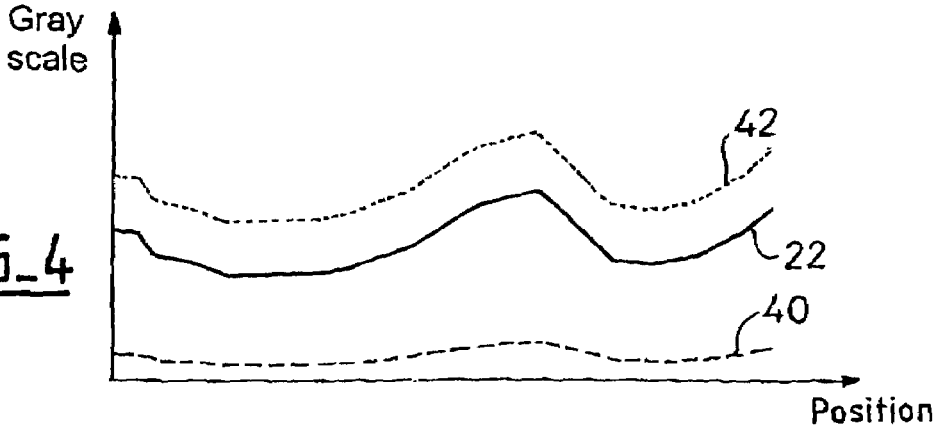
FIG. 4 illustrates histogram detected by the sensor according to other embodiments of the present invention.

FIG. 4 illustrates examples of reference histograms generated according to other embodiments of the present invention. The x- and y-axes are the same as previously described. The reference histogram 22 of FIG. 2 is also shown in FIG. 4.

If the light intensity detected by the sensor 28 decreases, the average gray level of the reference histogram 22 can decreases. For example, at night, the light intensity can decrease. FIG. 4 shows a reference histogram 40 obtained when the light intensity is low. When the light intensity is low, it is more difficult to detect the presence of an obstruction 12. A light source can generate light to compensate for the lack of light perception on the detector 14. Because a charge-coupled device sensor is sensitive to infrared light, it is preferably to use an infrared light source with the sensor is a charge-coupled device sensor. Additionally, an infrared light source does not disturb the occupants of the vehicle.

FIG. 4 also shows a reference histogram 42 obtained after activation of the light source. The reference histogram 42 is similar to histogram 22, but has higher gray levels because the upper edge 10 reflects light emitted by the light source. The light source may be a single or a distributed source, depending on the type and the position of the detector 14. Preferably, the light source is located next to the detector 14 to prevent light emitted by the light source from reaching the detector 14.

Even if a light source is utilized, the reflected light is not used directly for detection of an obstruction 12 and the gray level histogram is still analyzed on the detector 14. The similar appearance of histogram 42 and histogram 22 shows that the presence of a light source simply increases the ambient light.

The light source can be activated when the average level of the histogram, calculated over all of the positions is lower than a first threshold value. The light source can be deactivated when the average level of the histogram, calculated in the same way, exceeds a second threshold value. The light source can also be activated when the maximum value of the gray level on the histogram reaches another given value as to prevent saturation of the sensor. This solution simply involves adding to the processing module 34, with no need to provide a specific detector. The module 34 can then detect the light received by the sensor 28, and the gray levels must simply be integrated over all of the possible positions.

It is also possible to obtain the brightness or gray levels after integration of the values provided by the sensor 28, making detection of an obstruction 12 more reliable.

Preferably, the integration time is modified depending on the ambient brightness. If it is very bright, obstructions 12 will produce a large and easily detectable variation in gray levels. However, if the ambient brightness is lower, the variations due to an obstruction 12 decrease. Integration ensures that the obstructions 12 are always detected. The integration time is limited by the detection speed, which depends on the speed of movement of the window 8. The integration time is also limited by the choice of the reference histogram, as it is measured before the start of the integration period. In one example, a variable integration time of between 10 ms (the current charging time of the sensor 28) and 800 ms can be used for the charge-coupled device sensor. The first value is an instantaneous measurement of the values provided by the sensor pixels. The second value is the accumulation of the light in the photodiode over 800 ms, which is approximately the time to maximally charge the sensor 28.

When window 8 is automatically closed, the gray level histogram is recorded on the charge-coupled device sensor for 50 ms. The detected histogram is then compared with a previous histogram or reference histogram 22. If the variation between the detected histogram and the reference histogram exceeds a threshold, the movement of the window 8 is stopped. The window 8 can still be closed manually by pressing and holding down a close button. The automatic mode of the window 4 is again enabled when the window 8 reaches the upper edge 10 of the opening 4.

Of course, this invention is not limited to the embodiments described by way of example. The example described above discloses a door and a window, but the teaching above can also be applied to any openable member closed by a moving part, such as a sunroof. In this case, the expression "upper edge" is replaced by the "closing contact line" of the openable member. Both examples include an opening and a moving openable member in such opening.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. An obstruction detector comprising:

a light sensor having a plurality of imaging elements; and a circuit that analyzes a distribution of light received by the light sensor, wherein the distribution of light defines a histogram of gray levels of the plurality of imaging elements, the circuit compares the histogram of gray levels of the distribution of light received by the sensor to a reference histogram to detect an obstruction in a path of the distribution of light received by the light sensor, and the circuit updates the reference histogram.

2. The detector in claim 1, wherein the light sensor is a charge-coupled device sensor.

3. The detector in claim 1, further including a lens in a path of the distribution of light received by the light sensor.

4. The detector in claim 1, further including a light source to illuminate an area proximate to the light sensor.

5. The detector in claim 4, wherein the light source is an infrared light source.

6. The detector in claim 5, wherein the light source is activated when the distribution of light received by the light sensor is below a first threshold value.

7. The detector in claim 6, wherein the light source is deactivated when the distribution of light received by the light sensor is above a second threshold value.

8. The detector of claim 1, wherein the reference histogram is a reference histogram of gray levels.

9. An automobile vehicle part comprising:

an opening;

an openable member in the opening and moveable to a closing line, wherein the openable member contacts the closing line when the openable member is in a closed position; and a detector including a light sensor having a plurality of imaging elements and a circuit that analyzes a distribution of light received by the light sensor, wherein the distribution of light defines a histogram of gray levels of the plurality of imaging elements, the circuit compares the histogram of gray levels of the distribution of light received by the light sensor to a reference histogram, and the circuit updates the reference histogram.

10. The part in claim 9, wherein the light sensor detects an area approximately surrounding the closing line.

11. The part of claim 9, wherein the reference histogram is a reference histogram of gray levels.

12. A method of detecting an obstruction in a path of an openable member comprising the steps of:

detecting light along a closing line of the openable member with a light sensor to form a distribution of light, wherein the light sensor has a plurality of imaging elements and the distribution or light defines a histogram of gray levels of the plurality of imaging elements;

comparing the histogram of gray levels of the distribution of light along the closing line with a reference histogram;

indicating an obstruction when the step of comparing indicates the obstruction is in the path of the openable member; and updating the reference histogram.

13. The method in claim 12, wherein the step of detecting the light includes the steps of integrating and detecting an ambient brightness, and the step of integrating occurs over a period that depends on a level of the ambient brightness detected.

14. The method in claim 13, wherein the step of detecting the ambient brightness comprises measuring the light received by the light sensor.

15. The method in claim 12, further comprising the step of activating a light source when the light received by the light sensor is below a first threshold value.

16. The method in claim 15, further comprising the step of deactivating the light source when the light received by the light sensor is above a second threshold value.

17. The method of claim 12, wherein the reference histogram is a reference histogram of gray levels.

* * * * *